US005301821A

United States Patent [19]

Jeannet et al.

[11] Patent Number: 5,301,821

[45] Date of Patent: Apr. 12, 1994

[54] HOLDER FOR A BODY GROOMING TOOL

[75] Inventors: Roland Jeannet, Duesseldorf, Fed. Rep. of Germany; Robert Leutwyler, Boppelsen; Werner Leutwyler, Zurich, both of Switzerland

[73] Assignee: Johnson & Johnson Consumer Products, Inc., Skillman, N.J.

[21] Appl. No.: 13,280

[22] Filed: Feb. 4, 1993

[30] Foreign Application Priority Data

Feb. 19, 1992 [DE] Fed. Rep. of Germany ..... 4205027

[51] Int. Cl.[5] ..... A47F 7/00

[52] U.S. Cl. ..... 211/65; D6/534; 248/110; 206/209.1

[58] Field of Search ..... 211/65, 66, 104; 206/209.1; 248/110; D6/528, 534; 15/146, 167.1

[56] References Cited

U.S. PATENT DOCUMENTS 2,957,584 10/1960 Jenkins ..... 248/110
3,138,414 6/1964 La Pollo ..... 211/65 X
3,367,610 2/1968 Lindquist ..... 248/110
4,488,327 12/1984 Snider ..... 15/111
4,986,759 1/1991 Duncan ..... 211/66 X
4,995,509 2/1991 Kornfeind ..... 211/65 X
5,163,566 11/1992 Hempel ..... 211/65

FOREIGN PATENT DOCUMENTS 0326363 1/1989 European Pat. Off. .

*Primary Examiner*—Robert W. Gibson, Jr.

[57] ABSTRACT

In the case of a holder for a toothbrush, which holder comprises a plate (1) to be attached to a wall and a holding element (7) extending, in the usage position, perpendicular to the plate, the plate (1) and the holding element (7) are pivotably connected to each other and there is provided, moreover, on the plate (1), a suspension device (3), in which a magazine (10) containing accessories for the toothbrush can be suspended. When the holding element (7) is pivoted out of the open position into the usage position, the holding element (7) grips over the suspension device (3) in such a way that the magazine (10) is protected against unintended detachment from the holder.

3 Claims, 3 Drawing Sheets

HOLDER FOR A BODY GROOMING TOOL

The invention relates to a holder for a body grooming tool, having a plate to be attached to a wall and a holding element, extending essentially at a right angle thereto, for receiving the body grooming tool. Such a holder is known from US-A-4 488 327.

The known arrangement is designed for storing a number of one-part toothbrushes without accessories in a tidy and ready-to-hand manner. It comprises for this purpose an angled piece, one leg of which, a vertical plate, serves to attach the holder to a wall or similar. The other leg of the angled piece, which runs horizontally and stands out from the wall, is provided with a number of holes into which toothbrushes can be hung from above.

On the other hand, it is known from EP-A-0 326 363, for example, to equip toothbrushes with a removable brushhead and to accommodate the associated discardable brushheads in a magazine containing a number of such individually packed brushheads. In this case, the toothbrush handle, following piercing of a sealing film or similar, is pushed within the magazine onto the brushhead and locks fast on this, so that the brushhead does not need to be touched by hand as it is removed from the magazine.

The object of the invention is therefore to design the holder for a body grooming tool described in the introduction such that accessories for the body grooming tool can also be tidily accommodated.

This object is achieved by the fact that the plate and the holding element are pivotably connected to each other and that there is provided, on the plate, a device for the detachable attachment of a magazine containing accessories for the body grooming tool, the holding element, when swivelled into the usage position at a right angle to the plate, gripping over the suspension device in such a way that the magazine is protected against unintended detachment from the holder.

The pivotable connection between the vertical plate and the horizontal holding element has the effect that a magazine or another accessory part can be suspended on the holder and can be exchangeably attached to the latter, so that even if that force which is necessary to mount the brushheads onto a toothbrush handle is applied for instance to a magazine for the brushheads of toothbrushes, the magazine remains reliably suspended on the holder.

In an advantageous further design of the invention, the body grooming tool can comprise a toothbrush having a removable brushhead, the accessories magazine being a magazine for replacement brushheads. The suspension device can comprise spreading spigots, which engage into holes in the holding element.

The invention is explained in greater detail below with reference to the diagrammatic drawing of an illustrative embodiment, in which.

Figure 1:
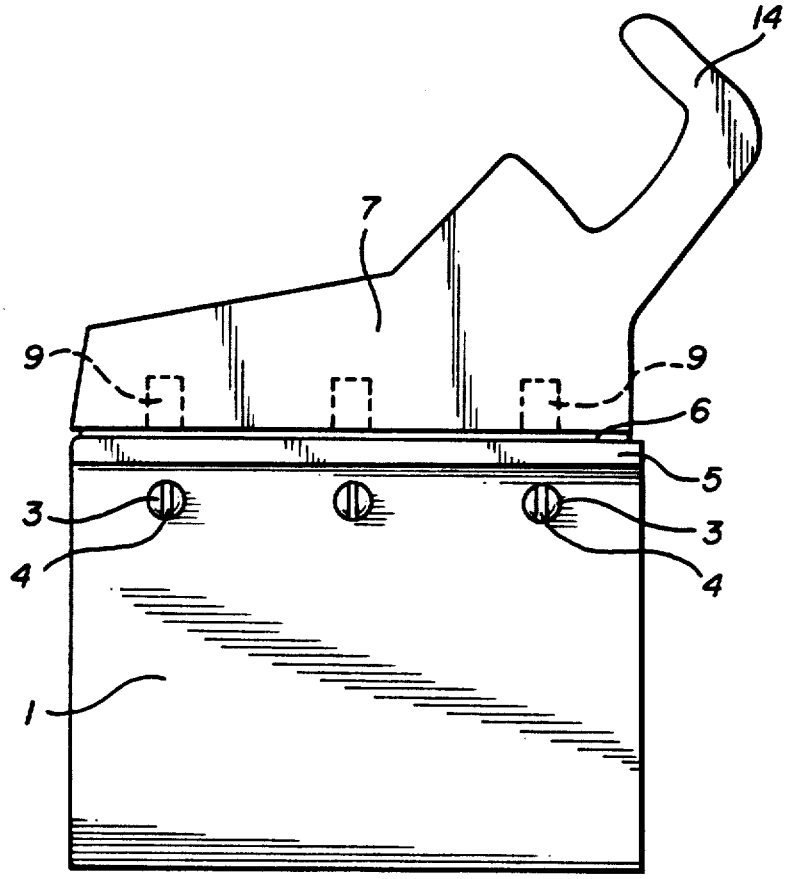
FIG. 1 shows a view of an opened-out holder.
Figure 2:
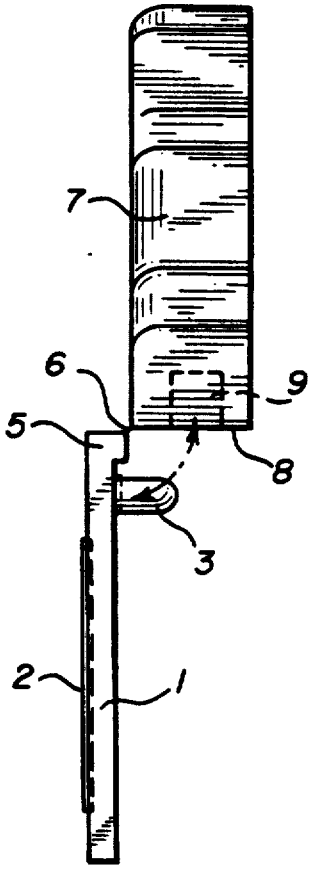
FIG. 2 shows a side view of the opened-out holder in FIG. 1.

The illustrative embodiment shown in the drawing represents a holder for a toothbrush having a removable brushhead and for a magazine containing replacement brushheads. As shown in FIGS. 1 and 2 in particular, the holder comprises a plate 1, which is provided on the back with a self-adhesive layer 2 for fitting the holder to a wall or similar. In place of the self-adhesive layer 2, fastening screws or other fastening means can also be provided. The plate 1 exhibits on its front side, close to its top edge, cylindrical spigots 3 which stands out at a right angle from the plate surface and, as a result of diametral slots 4, are configured resiliently in the manner of spreading spigots.

At the top edge of the plate 1, there is a transverse strip 5, the outer edge of which is provided with a hinge 6 which connects the plate 1 pivotably to a holding element 7 for receiving a toothbrush. The hinge 6 can consist, for example, of a hinged film, so that the plate 1 and the holding element 7 can be made in one piece from a suitable plastic material. The side wall 8, adjoining the hinge 6, of the holding element 7 is provided with holes 9, which are configured as long holes, the smallest diameter and spacing of which correspond approximately to that of the spigots 3 on the plate 1. The major axis of the long holes runs perpendicular to the hinge 6, the minor axis thereof corresponds to the diameter of the spigots 3 or is slightly smaller and the diametral slots 4 in the spigots 3 are disposed parallel to the major axis of the long holes or also perpendicular to the hinge 6, so that the holding element 7, in the usage position, is firmly clamped by a clamp-fit to the spigots 3. When the holding element 7 is swivelled out of the open position according to FIGS. 1 to 3, in which the holding element 7 extends essentially parallel to the plate 1, into the closed or usage position of the holder according to FIGS. 4 and 5, in which the plate 1 and the holding element 7 form an angle of around 90°, the spigots 3 engage by locking or by friction-fit into the holes 9.

Figure 3:
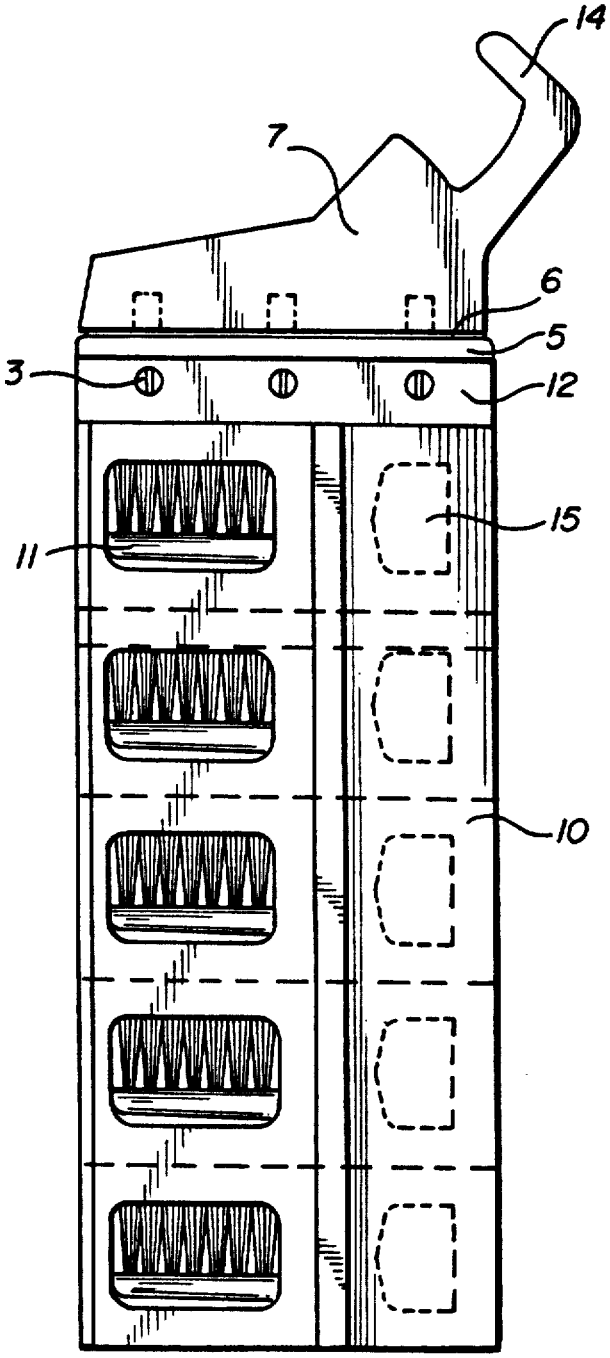
FIG. 3 shows a view of the opened-out holder with an attached accessories magazine
Figure 4:
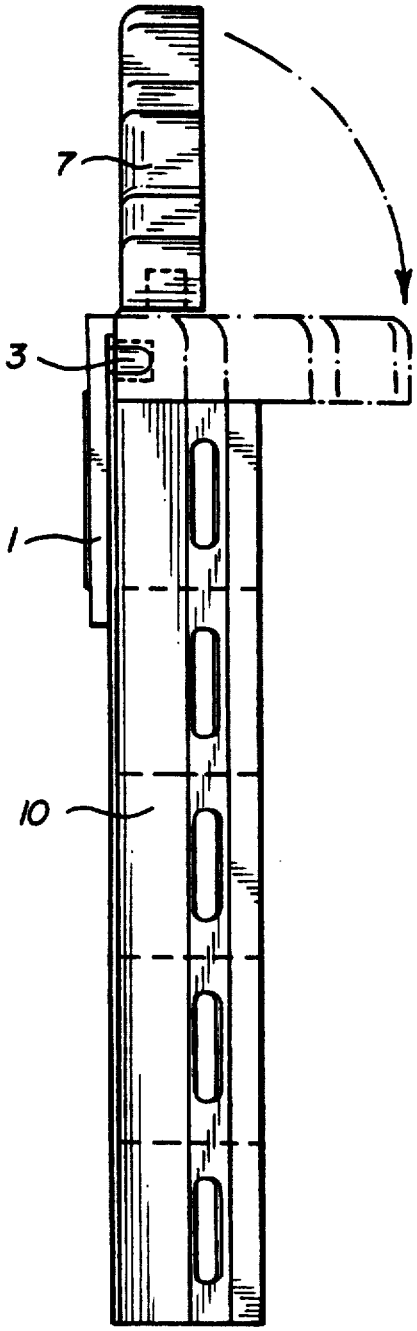
FIG. 4 shows a side view of the holder with an attached accessories magazine.
Figure 5:
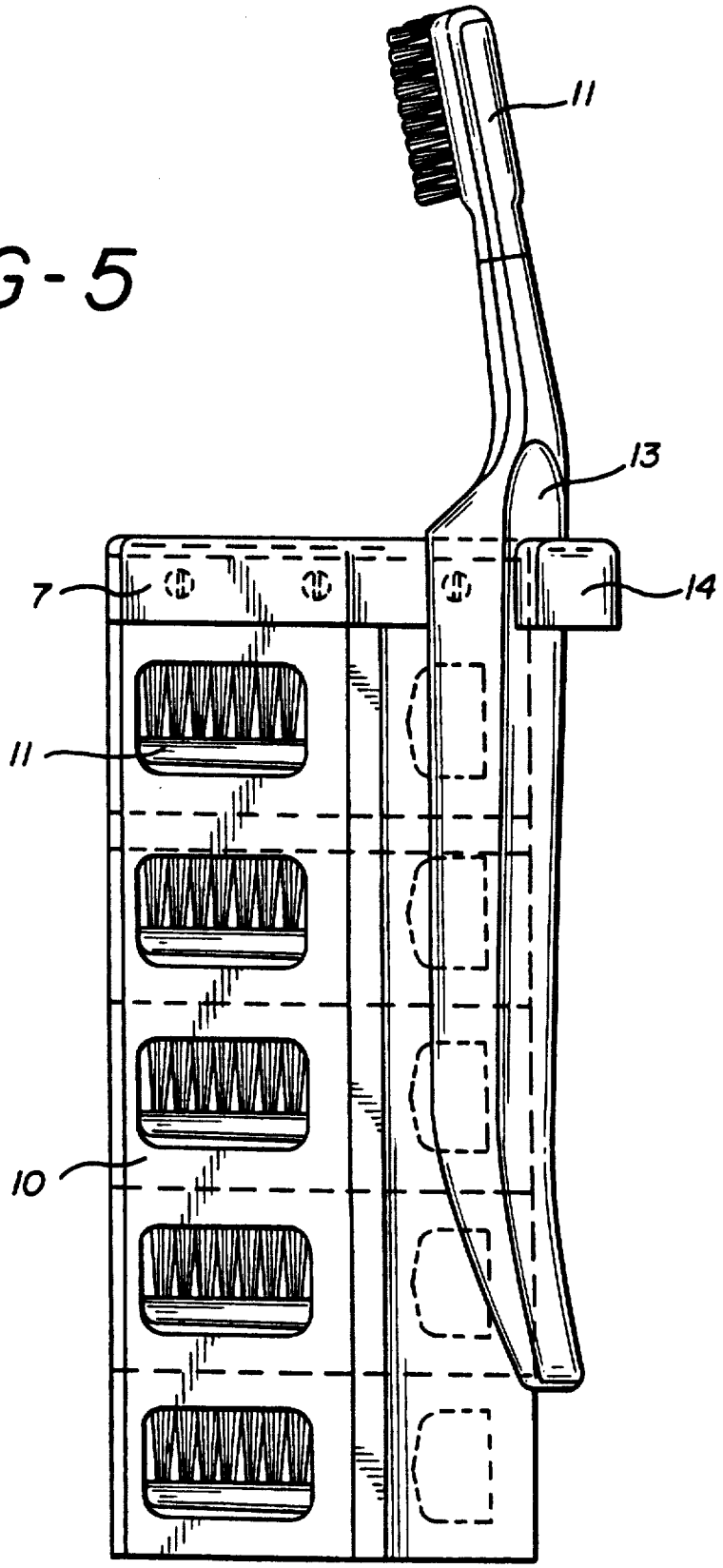
FIG. 5 shows a front view of the holder with an attached accessories magazine and suspended toothbrush.

In the open position, as is shown in FIGS. 3 and 4, a magazine 10 for replacement brushheads can be hung over the spigots 3 on the plate 1, which magazine contains a number of compartments, in the present example five compartments, in each case holding a brushhead 11. The magazine 10 exhibits at its top edge a tab 12 having holes which correspond approximately in size and arrangement to the spigots 3 on the plate 1. Following the suspension of the magazine 10 on the spigots 3, the holding element 7 is swivelled into the usage position, i.e. folded downwards, the long holes 9 in the holding element 7 gripping by friction-fit over spigots 3 and the magazine 10 thus being secured against the holder (FIG. 4). In this usage position, the holding element 7 essentially fully covers the tab 12 of the magazine 10 and locks the magazine in place. As shown in FIG. 5, a toothbrush or a toothbrush handle 13 can then be suspended in the holding element 7 with or without an attached brushhead 11, for which purpose the holding element 7 is provided with a fork 14 and the toothbrush handle 13 is shaped accordingly.

In the usage position, the magazine 10 is thus firmly anchored to the plate 1 and cannot slip even when, for the mounting of a new brushhead 11 onto a toothbrush handle 13, a seal 15 on the magazine 10 is pushed open by means of the handle 13 and the handle 13 is connected to the brushhead 11, for which purpose a certain force is necessary. An empty magazine 10 can be readily replaced by a new one, in that the holder is opened by the holding element 7 being folded upwards.

We claim:

1. Holder for a body grooming tool, having a plate (1) to be attached to a wall and a holding element (7), extending essentially at a right angle thereto, for receiving the body grooming tool (13), characterised in that the plate (1) and the holding element (7) are pivotably connected to each other and in that there is provided, on the plate (1), a suspension device (3) for the detachable attachment of a magazine (10) containing accessories for the body grooming tool, the holding element (7), when swivelled into the usage position at a right angle to the plate (1), gripping over the suspension device (3) in such a way that the magazine (10) is protected against unintended detachment from the holder.

2. Holder according to claim 1, characterised in that the body grooming tool is a toothbrush having a removable brushhead (11), the accessories magazine being a magazine (10) for replacement brushheads.

3. Holder according to claim 1, characterised in that the suspension device comprises spreading spigots (3), which engage into holes (9) in the holding element (7).

* * * * *